US005210368A

United States Patent [19]

Heller, Jr. et al.

[11] Patent Number: 5,210,368

[45] Date of Patent: May 11, 1993

[54] BOMB NEUTRALIZING APPARATUS

[76] Inventors: James M. Heller, Jr., 17 Old Spring Ct., Cockeysville, Md. 21030; Gerald C. Peterson, 6636 Washington Blvd. #9, Elkridge, Md. 21227; Michael J. Whalen, 706 Country Village Dr. Apt. 3A, Bel Air, Md. 21014

[21] Appl. No.: 868,673

[22] Filed: Apr. 15, 1992

[51] Int. Cl.[5] ..... F41A 19/70; F42B 33/06

[52] U.S. Cl. ..... 86/50; 42/84; 89/1.1; 89/28.1

[58] Field of Search ..... 42/84; 89/28.1, 1.11, 89/1.1, 1.819, 1.8; 86/50

[56] References Cited

U.S. PATENT DOCUMENTS 1,661,091 2/1928 Riabouchinski ..... 89/1.1
1,987,912 1/1935 Rady et al. ..... 42/84
3,117,518 1/1964 Porter et al. ..... 89/50
3,216,320 11/1965 Thomas et al. ..... 89/1.1
3,643,545 2/1972 Nahas ..... 42/84
4,046,055 9/1977 McDanolds et al. ..... 89/28.1
4,169,403 10/1979 Hanson ..... 86/50
4,757,629 7/1988 Austin ..... 42/84
5,044,252 9/1991 Gamadi et al. ..... 86/50

*Primary Examiner*—David H. Brown
*Attorney, Agent, or Firm*—Leon Gilden

[57] ABSTRACT

An apparatus is arranged to permit remote detonation of bombs and testing of such devices to include a tripod structure rotatably mounting a barrel assembly at its lower distal end utilizing remote actuating switching to permit remote detonation of an explosive device or device to be so tested by projecting a trajectory at the device to be tested.

6 Claims, 4 Drawing Sheets

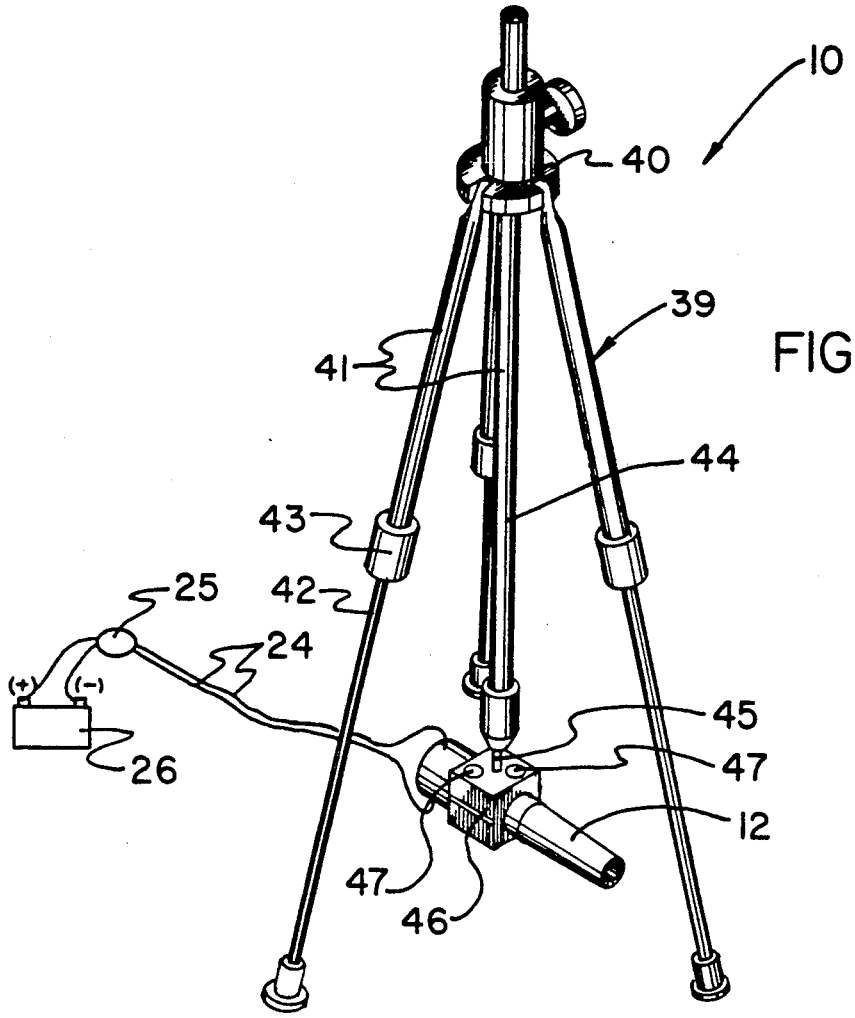
FIG. 9
FIG. 11
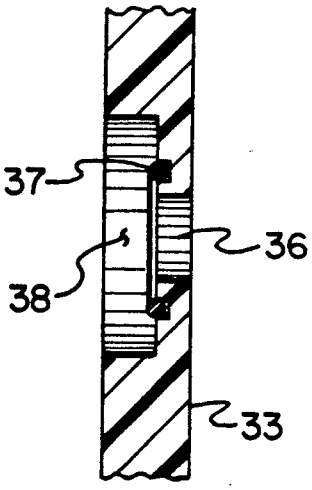
FIG. 10
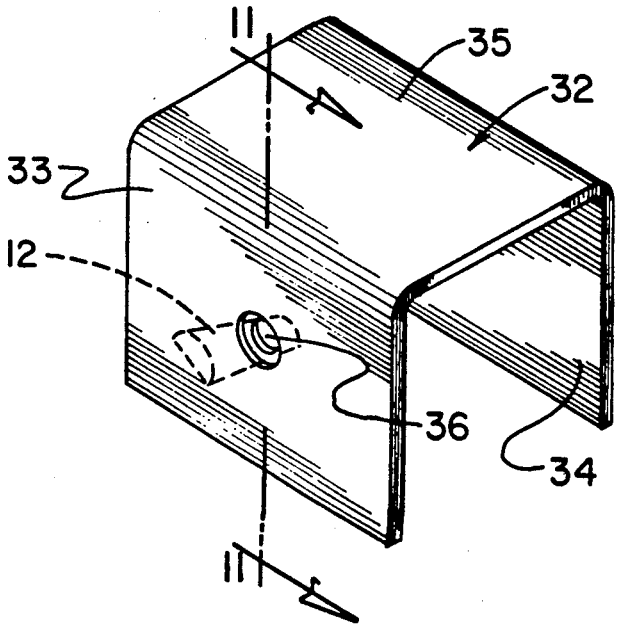

BOMB NEUTRALIZING APPARATUS

BACKGROUND OF THE INVENTION

1. Field of the Invention

The field of invention relates to bomb neutralizing devices, and more particularly pertains to a new and improved bomb neutralizing apparatus wherein the same is arranged for remote detonation of various bombs and devices to be tested by imparting an accelerated charge at such devices.

2. Description of the Prior Art

In dealing with contemporary terrorism and the like, devices to permit remote exploding and detonation of various devices or at least the testing of such devices at safe distances is an ever present requirement in contemporary society. The instant invention attempts to overcome deficiencies of the prior art by providing for an assemblage easily transported and manually manipulated by an individual permitting such on-site detonation and testing of devices of suspicious construction. Further, the invention permits the precise aiming of a charge or projectile at such devices permitting the removal and partial dismantling of such devices such as bombs and the like subsequent to the devices being neutralized permitting subsequent analysis of such bombs to create a greater availability of evidence to capture individuals depositing such suspicious constructions in an unlawful manner.

U.S. Pat. No. 4,100,978 to Boop sets forth a technique for arming electrically fireable explosive well tools utilizing a plurality of blasting cap perforated element assemblages disposed on the tool with a detonation perforating element arming the next adjacent blasting cap.

U.S. Pat. No. 4,779,535 to Maki sets forth a slug assembly for use in shotgun shell constructions.

U.S. Pat. Nos. 4,431,350 and 3,948,177 are examples of self-disarming apparatus permitting self-disarming in the event of misfire.

Accordingly, it may be appreciated that there continues to be a need for a new and improved bomb neutralizing apparatus as set forth by the instant invention which addresses both the problems of ease of use as well as effectiveness in construction in permitting selective removal of various components of a bomb permitting its ease of subsequent disassembly for examination and in this respect, the present invention substantially fulfills this need.

SUMMARY OF THE INVENTION

In view of the foregoing disadvantages inherent in the known types of bomb handling apparatus now present in the prior art, the present invention provides a bomb neutralizing apparatus wherein the same is arranged for the detonation and/or partial disassembly of a bomb member permitting analysis thereof. As such, the general purpose of the present invention, which will be described subsequently in greater detail, is to provide a new and improved bomb neutralizing apparatus which has all the advantages of the prior art bomb examination apparatus and none of the disadvantages.

To attain this, the present invention provides an apparatus arranged to permit remote detonation of bombs and testing of such devices to include a tripod structure rotatably mounting a barrel assembly at its lower distal end utilizing remote actuating switching to permit remote detonation of an explosive device or device to be so tested by projecting a trajectory at the device to be tested.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved bomb neutralizing apparatus which has all the advantages of the prior art bomb handling apparatus and none of the disadvantages.

It is another object of the present invention to provide a new and improved bomb neutralizing apparatus which may be easily and efficiently manufactured and marketed.

It is a further object of the present invention to provide a new and improved bomb neutralizing apparatus which is of a durable and reliable construction.

An even further object of the present invention is to provide a new and improved bomb neutralizing apparatus which is susceptible of a low cost of manufacture with regard to both materials and labor, and which accordingly is then susceptible of low prices of sale to the consuming public, thereby making such bomb neutralizing apparatus economically available to the buying public.

Still yet another object of the present invention is to provide a new and improved bomb neutralizing apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 9 is an isometric illustration of the invention in an assembled configuration.

FIG. 10 is an isometric illustration of an explosion control housing of the invention.

FIG. 11 is an orthographic view, taken along the lines 11—11 of FIG. 10 in the direction indicated by the arrows.

DESCRIPTION OF THE PREFERRED EMBODIMENT

Figure 1:
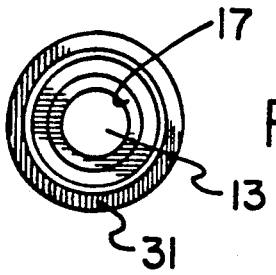
FIG. 1 is an orthographic end view of the barrel assembly of the invention.
Figure 2:
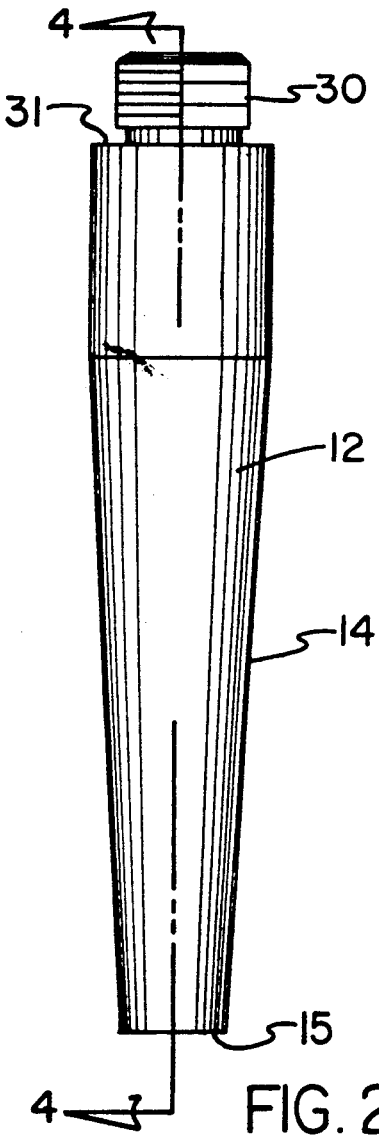
FIG. 2 is an orthographic side view, taken in elevation, of the barrel assembly.
Figure 4:
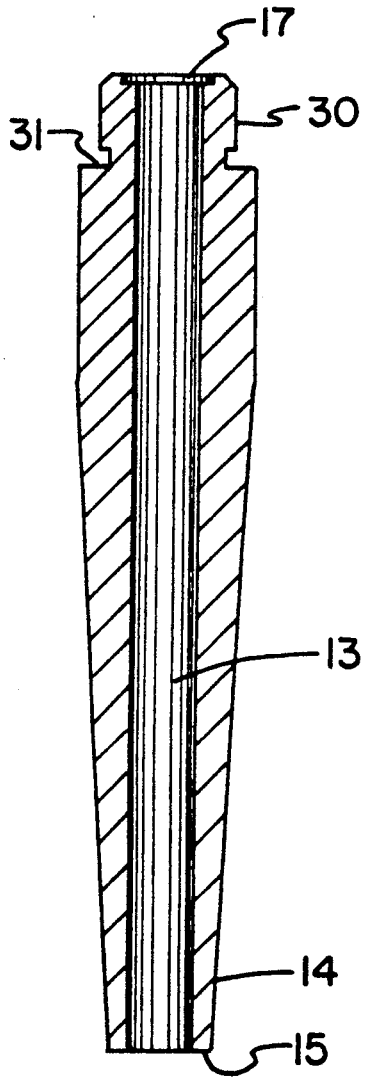
FIG. 4 is an orthographic cross-sectional view, taken along the lines 4—4 of FIG. 2 in the direction indicated by the arrows.
Figure 3:
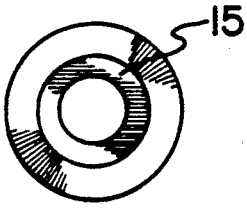
FIG. 3 is an orthographic rear end view of the barrel member.
Figures 5, 6, 7:
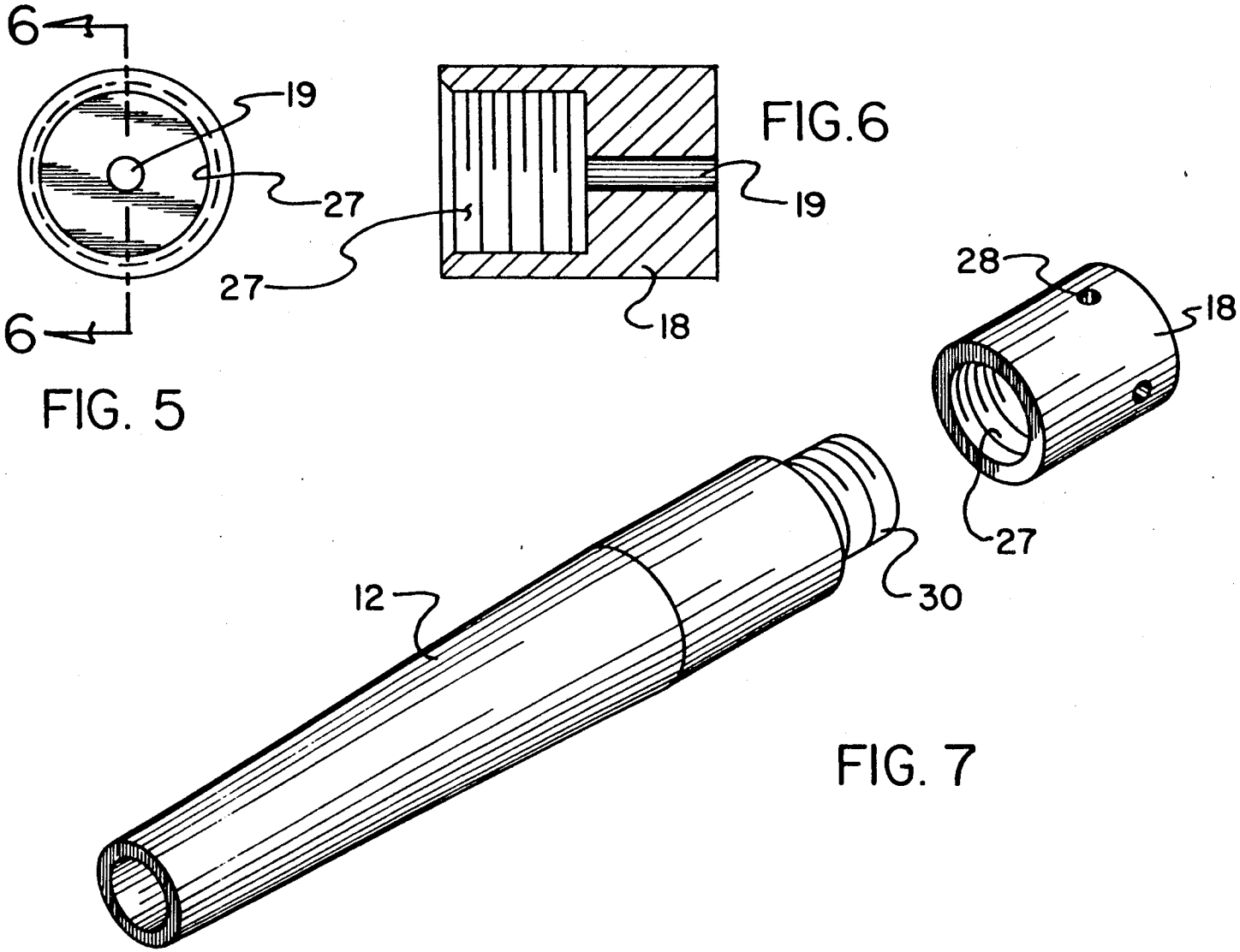
FIG. 5 is an orthographic end view of the mounting housing of the invention.
FIG. 6 is an orthographic view, taken along the lines 6—6 of FIG. 5 in the direction indicated by the arrows.
FIG. 7 is an isometric illustration of the mounting housing secured to the barrel member.

With reference now to the drawings, and in particular to FIGS. 1 to 11 thereof, a new and improved bomb neutralizing apparatus embodying the principles and concepts of the present invention and generally designated by the reference numeral 10 will be described.

Figure 8:
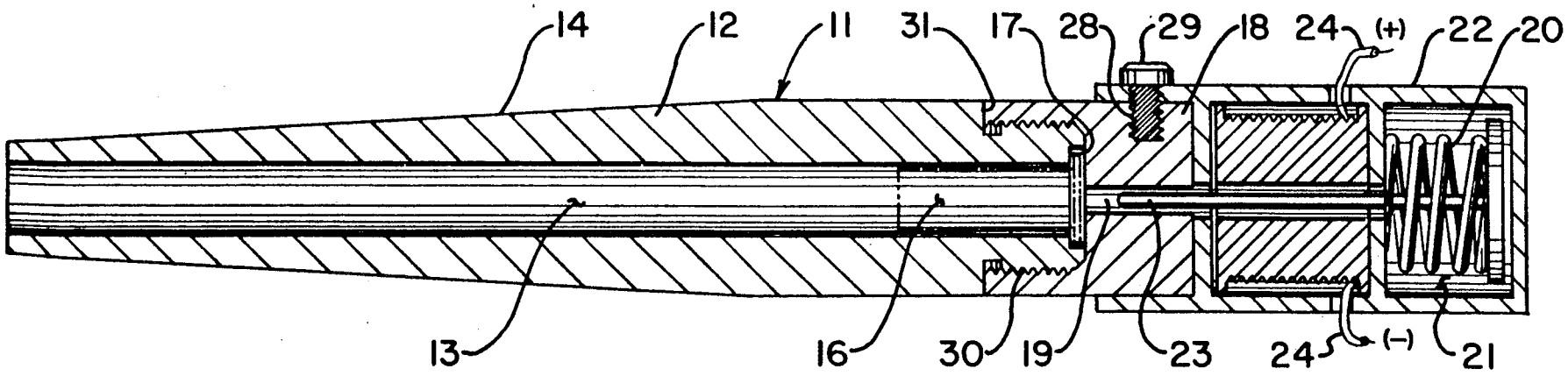
FIG. 8 is an orthographic cross-sectional view of the assembled barrel member and solenoid actuator of the invention.

More specifically, the bomb neutralizing apparatus 10 of the instant invention essentially comprises a firing assembly 11, such as illustrated in FIG. 8, to include a forward barrel 12 having a truncated conical outer periphery 14 terminating in a merging manner towards a barrel forward distal end 15, with the barrel chamber 16 directed through a rear entrance 17 of the forward barrel 12. An annular barrel shoulder flange 31 is defined about a barrel externally threaded boss 30, with a shot shell (illustrated in phantom in FIG. 8) arranged for reception within the barrel chamber 16 through the rear entrance end 17. A mounting housing 18 includes a mounting housing bore 19 directed therethrough that is coaxially aligned with the barrel central bore 13. Further, a mounting housing internally threaded second bore 27 of a second diameter greater than a first diameter defined by the mounting housing bore 19 has an internally threaded interior wall for threadedly receiving the externally threaded boss 30. The mounting housing 18 further includes a plurality of mounting housing lock bores 28 radially directed into the mounting housing for receiving a lock fastener 29 that projects through fastener bores an annular skirt of an associated solenoid housing 22 coaxially aligned with the mounting housing 18 mounted to a rear distal end of the mounting 18 that is in turn coaxially aligned with the barrel bore 13. The solenoid housing 22 includes a solenoid 20 contained therewithin positioned within a solenoid chamber 21 having a solenoid firing pin 23 coaxially aligned and received within the mounting housing bore 19, whereupon actuation of the solenoid effects forward projection of the solenoid firing pin 23 to detonate the shotgun shell, as illustrated in phantom in FIG. 8. Electrical lines 24 are directed from the solenoid 20 to a switch 25 (see FIG. 9) and from there to a battery 26, whereupon actuation of the switch 25 effects electrical communication between the battery and the solenoid to effect actuation and forward projection of the firing pin 23 into the shotgun shell.

The firing assembly 11 is mounted to a split mounting block 46 having block fasteners 47 securing a plurality of block portions together to receive the firing assembly therewithin. The mounting block is mounted to a lower distal end of a central support shaft 44 that includes a shaft lower swivel connection 45 to pivotally mount the split mounting block 46 relative to a tripod assembly 39. The tripod assembly 39 includes a tripod plate 40 having a plurality of tripod legs 41 of telescoping construction, wherein each of the legs 41 include an extension leg 42 having a collet 43 to permit extension of each extension leg relative to each tripod leg 41 permitting a compact construction when interfolded relative to one another.

An explosion control housing 32 is provided having a front wall 33 spaced from a rear wall 34 having open side wall ends, with a top wall 35. The front wall 33 includes a wall bore 36 directed therethrough having an annular resilient seal 37 arranged for receiving the conical outer periphery 14 of the forward barrel 12 therethrough, with the annular resilient seal 37 affording frictional alignment of the forward barrel 12 through the housing 32, with a front wall relief cavity 38 directed into an interior surface of the front wall 33 in surrounding relationship relative to the wall bore 36 to accommodate positioning of an alignment of the barrel 12 through the front wall. In this manner, should a device inadvertently detonate, the charge is directed laterally of the housing 32 to minimize damage to the apparatus during use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bomb neutralizing apparatus, comprising, a tripod assembly, the tripod assembly having a tripod plate including a plurality of tripod legs, each leg of said tripod legs includes an extension leg telescopingly mounted relative to a respective tripod leg, and the tripod assembly includes a central support shaft extending medially and downwardly relative to the tripod plate between the tripod legs, and a lower distal end of the central support shaft includes a shaft lower swivel connection, and a mounting block mounted to the shaft lower swivel connection, and the mounting block including a firing assembly mounted within the mounting block, and the firing assembly includes a forward barrel, the forward barrel having a barrel bore coaxially directed through the forward barrel, including a truncated conical outer periphery merging towards a barrel forward distal end, and the forward barrel having a barrel rear entrance end, with the rear entrance end formed with a barrel chamber therewithin to receive a projectile, and the barrel rear entrance end including an annular barrel shoulder flange arranged in surrounding relationship relative to the barrel rear entrance end, and the forward barrel further having an externally threaded barrel boss coaxially aligned with the forward barrel extending rearwardly of the barrel rear entrance end, and a mounting housing having a mounting housing bore of a first diameter, the mounting housing bore coaxially aligned with the mounting housing and the barrel bore when the mounting housing is secured to the forward barrel, with the mounting housing including a mounting housing internally threaded second bore defined by a second diameter greater than the first diameter, the mounting housing second bore coaxially aligned with the mounting housing bore, and the mounting housing bore arranged for threadedly receiving the externally threaded barrel boss.

2. An apparatus as set forth in claim 1 further including a solenoid housing secured to the mounting housing, the solenoid housing including an annular skirt, the annular skirt including a plurality of fastener bores directed therethrough, and the mounting housing including a plurality of mounting housing lock bores directed therethrough, wherein each fastener bore receives a fastener and each fastener is arranged for reception within a mounting housing lock bore.

3. An apparatus as set forth in claim 2 wherein the solenoid housing includes a solenoid housing chamber, the solenoid housing chamber including a solenoid therewithin, the solenoid including a solenoid firing pin, the solenoid firing pin coaxially aligned with and directed through the mounting housing bore coaxially aligned with the barrel chamber, whereupon actuation of the solenoid effects projection of the firing pin into the barrel chamber, and a plurality of electrical lines directed from the solenoid, the electrical lines directed into an electrical switch, and a battery in electrical communication with the solenoid through the electrical switch for effecting selective actuation of the solenoid.

4. An apparatus as set forth in claim 3 wherein the mounting housing includes a mounting housing forward distal end arranged for abutment with the annular barrel shoulder flange when the mounting housing is secured to the barrel boss.

5. An apparatus as set forth in claim 4 further including an explosion control housing, the explosion control housing including a front wall spaced from a rear wall, and a top wall, and the control housing including open side walls, and the front wall including a wall bore, the wall bore including an annular resilient seal arranged in surrounding relationship relative to the wall bore directed into the wall bore for frictional engagement with the truncated conical outer periphery of the forward barrel when the forward barrel is directed through the wall bore for alignment of the forward barrel within the explosion control housing.

6. An apparatus as set forth in claim 5 wherein the front wall includes a front wall interior surface, and the interior surface has a relief cavity arranged in surrounding relationship about the wall bore to permit ease of alignment of the forward barrel within the explosion control housing.

* * * * *